US008545004B2

(12) United States Patent
Pattekar et al.

(10) Patent No.: US 8,545,004 B2
(45) Date of Patent: Oct. 1, 2013

(54) CONTACTLESS INK LEVELING METHOD AND APPARTUS

(75) Inventors: Ashish V. Pattekar, Cupertino, CA (US); Lars Erik Swartz, Sunnyvale, CA (US); David K. Biegelsen, Portola Valley, CA (US); Armin R. Volkel, Mountain View, CA (US); Gregory J. Kovacs, Webster, NY (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 13/353,126

(22) Filed: Jan. 18, 2012

(65) Prior Publication Data

US 2012/0120169 A1 May 17, 2012

Related U.S. Application Data

(62) Division of application No. 11/962,544, filed on Dec. 21, 2007, now Pat. No. 8,118,420.

(51) Int. Cl.
*B41J 2/01* (2006.01)

(52) U.S. Cl.
USPC ..... 347/101; 347/104; 101/488

(58) Field of Classification Search
USPC ..... 347/101–105; 101/488
See application file for complete search history.

(56) References Cited

U.S. PATENT DOCUMENTS

| | | | | |
|---|---|---|---|---|
| 3,318,018 | A * | 5/1967 | Lake et al. | 34/62 |
| 4,751,528 | A * | 6/1988 | Spehrley et al. | 347/18 |
| 5,642,671 | A | 7/1997 | Winheim | |
| 5,730,058 | A | 3/1998 | Borgardt | |
| 6,067,437 | A | 5/2000 | Schonfeld | |
| 6,299,685 | B1 * | 10/2001 | Siler et al. | 118/58 |
| 6,376,024 | B1 * | 4/2002 | Siler et al. | 427/458 |
| 6,435,094 | B1 * | 8/2002 | Siler et al. | 101/488 |
| 6,832,831 | B2 | 12/2004 | Shima | |
| 6,983,696 | B2 | 1/2006 | Koch | |
| 7,134,750 | B2 * | 11/2006 | Hasebe et al. | 347/102 |
| 7,316,474 | B2 * | 1/2008 | Tatsumi et al. | 347/101 |
| 2002/0033869 | A1 | 3/2002 | Kurabayashi et al. | |
| 2004/0017454 | A1 | 1/2004 | Yoshizawa et al. | |
| 2008/0152373 | A1 | 6/2008 | Ahn et al. | |
| 2009/0304952 | A1 * | 12/2009 | Kritchman | 427/595 |

FOREIGN PATENT DOCUMENTS

| | | |
|---|---|---|
| EP | 1577102 | 9/2005 |
| WO | WO2004002746 | 1/2004 |

* cited by examiner

*Primary Examiner* — Matthew Luu
*Assistant Examiner* — Rut Patel
(74) *Attorney, Agent, or Firm* — Marger Johnson & McCollom PC

(57) ABSTRACT

A method of leveling ink that is printed on a substrate includes establishing a thermal gradient across a thickness of the substrate, the thermal gradient characterized in that it is less than a viscosity threshold temperature of the ink across most of the substrate.

11 Claims, 12 Drawing Sheets

CONTACTLESS INK LEVELING METHOD AND APPARTUS

CROSS-REFERENCE TO RELATED APPLICATIONS

This is a Division of co-pending U.S. patent application Ser. No. 11/962,544 filed Dec. 21, 2007, entitled CONTACTLESS INK LEVELING METHOD AND APPARATUS, the disclosure of which is herein incorporated by reference in its entirety.

BACKGROUND

Some types of ink, for example, an Ultraviolet (UV) curable gel ink, can become very viscous or sticky after being applied to a substrate by the ink-jet process and may exhibit an undesirable "corduroy" structure after being applied. For purposes of this disclosure, the noun substrate shall refer to the medium upon which the ink is applied, including, but not limited to, a porous substrate such as paper. For purposes of this disclosure, the adjective porous as applied to the substrate refers to the fact that the substrate includes pores that are permeable by the ink.

It would be desirable to have a method and apparatus for leveling the ink on the substrate without physically touching it with an object such as a brush or knife edge. It would also be desirable to prevent the ink from infusing significantly into the porous paper in order to maintain image quality and to enable the complete subsequent curing of the ink. Example embodiments described in this disclosure address these and other disadvantages of the related art.

DETAILED DESCRIPTION OF THE EMBODIMENTS

The presently described embodiments disclose methods and apparatus for contactless leveling of inks that create a steep thermal gradient through a substrate where the ink is being applied. Most of the substrate is maintained below a viscosity temperature threshold $T_0$, while the ink itself is heated above the viscosity temperature threshold $T_0$. This approach advantageously allows the top surface temperature to be maintained above the viscosity threshold for a sufficient time to allow the ink to flow laterally. The approach also maintains most or all of the substrate below the viscosity threshold to prevent excessive seepage or "bleed-through" of the ink into the porous substrate.

According to some embodiments, steam is employed to rapidly heat the ink and the surface of the porous substrate to a high temperature at which the viscosity of the ink becomes low enough to allow local reflow under surface/interfacial tension forces and under the capillary interaction with the substrate. Preferably, the high temperature is below the boiling point of water, but this is not a requirement. A steep thermal gradient through the porous substrate provides a means to maintain the ink in the gel state near the top surface of the substrate, preventing the ink from penetrating a significant way into the substrate. The thermal gradient can be created by cooling the bottom side of the substrate while heating the top (ink) side of the substrate. According to some other embodiments, hot air may be used to heat the ink and the ink side of the porous substrate. According to other embodiments, a combination of both steam and hot air may be used.

Figure 1:
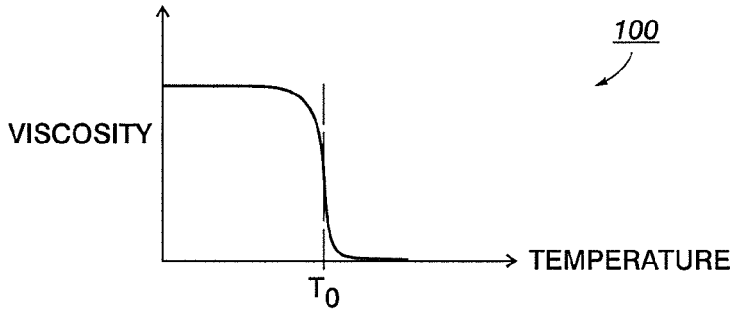
FIG. 1 is a graph that illustrates the viscosity as a function of temperature for a typical gel ink that is compatible with example embodiments.

FIG. 1 is a graph 100 that illustrates the viscosity as a function of temperature for a typical gel ink that is compatible with example embodiments. Referring to FIG. 1, the graph 100 shows that the viscosity profile for the gel ink has a rather sharp threshold. There is a relatively narrow range of temperatures where the gel ink transitions from being relatively viscous (on the order of greater than $10^4$ centipoise, or cP) and unable to flow easily to being relatively non-viscous (on the order of less than 1000 cP) and able to flow easily.

The UV curable gel ink whose properties are described in FIG. 1 has been described in copending U.S. application Ser. No. 11/290,202, filed Nov. 30, 2005, entitled "Phase Change Inks Containing Photoinitiator With Phase Change Properties and Gellant Affinity," with the named inventors Peter G. Odell, Eniko Toma, and Jennifer L. Belelie, the disclosure of which is totally incorporated herein by reference, and discloses a phase change ink comprising a colorant, an initiator, and an ink vehicle; in copending U.S. application Ser. No. 11/290,121, filed Nov. 30, 2005, entitled "Phase Change Inks Containing Curable Amide Gellant Compounds," with the named inventors Eniko Toma, Jennifer L. Belelie, and Peter G. Odell, the disclosure of which is totally incorporated herein by reference, and discloses a phase change ink comprising a colorant, an initiator, and a phase change ink carrier; and also in copending U.S. application Ser. No. 11/289,615, filed Nov. 30, 2005, entitled "Radiation Curable Ink Containing A Curable Wax," with the named inventors Jennifer L. Belelie, et al., the disclosure of which is totally incorporated herein by reference, and discloses a radiation curable ink comprising a curable monomer that is liquid at 25° C., curable wax and colorant that together form a radiation curable ink.

In graph 100, there also exists a threshold temperature $T_0$, which is defined as the temperature at which the viscosity of the gel ink is approximately 50% of the maximum viscosity. It should be recognized that this definition of threshold temperature is somewhat arbitrary and could just as easily be defined as, for example, a temperature at which the viscosity of the gel ink is approximately 10% of the maximum viscosity. At any rate, the threshold temperature $T_0$ should be selected such that above the threshold temperature $T_0$ the gel ink can flow relatively easily. According to example embodiments, the ink is heated above the threshold temperature $T_0$ so that the ink may flow readily under the influence of surface/interfacial tension and interfacial capillary forces and/or externally supplied shear forces. According to some embodiments, the gel ink is applied to the substrate at room temperature before being heated. In other embodiments, the gel ink can be heated before being applied to the substrate.

While heating the ink to above the threshold temperature $T_0$ is helpful for spreading the ink over the surface of the substrate, it also encourages the ink to be imbibed into the porous structure of the substrate. Therefore, according to example embodiments, a thermal gradient may be established across the substrate. The thermal gradient is established such that the temperature is below the threshold temperature $T_0$ for most, and more preferably all, locations in the substrate.

The thermal gradient may be established by cooling the bottom of the substrate while heating the top of the substrate, either before or after the ink is applied to the top of the substrate. Because the temperature within the substrate rapidly drops below the threshold temperature $T_0$ as the depth into the substrate increases, the imbibed ink rapidly loses its ability to move further into the porous substrate. Thus, one can maintain the top surface temperature for sufficient time to allow the applied ink to flow laterally while avoiding significant seepage or "bleed-through" into the porous substrate.

Figure 2:
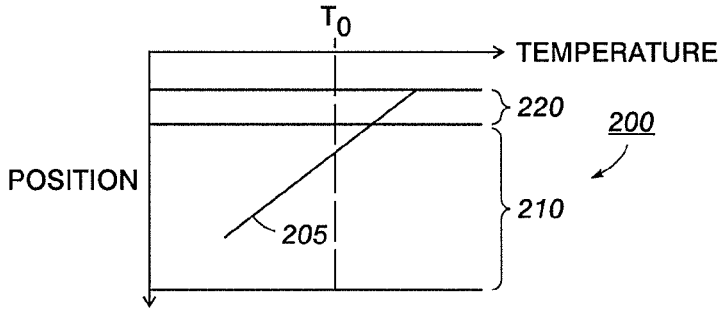
FIG. 2 is a graph that illustrates the temperature gradient across a substrate and an ink layer in accordance with example embodiments.

FIG. 2 is a graph 200 that illustrates a thermal gradient 205 across a substrate 210 and an ink layer 220 that is in accordance with example embodiments. Graph 200 reveals that the temperature of the substrate decreases linearly as the depth into the substrate increases, and that the majority of the substrate exhibits a temperature that is below the threshold temperature $T_0$. Although the rate at which temperature decreases across the ink layer 220 and the substrate 210 in graph 200 are shown as being equal, this may not always be the case. Furthermore, other temperature gradients in accordance with example embodiments need not be linear and may vary from the shape of thermal gradient 205 depending on the specific material and composition of the substrate.

According to example embodiments, heating of the substrate may be accomplished using the application of hot air or some other fluid. This involves convective heat transfer, which is defined as a mechanism of heat transfer that occurs because of the bulk motion or observable movement of a fluid. According to other example embodiments, the heating of the substrate may be accomplished using the application of steam. This involves both convective heat transfer and condensation heat transfer. Condensation heat transfer is much faster than convective heat transfer alone due to the release of latent heat associated with the phase change of water vapor to a liquid state.

Figure 3:
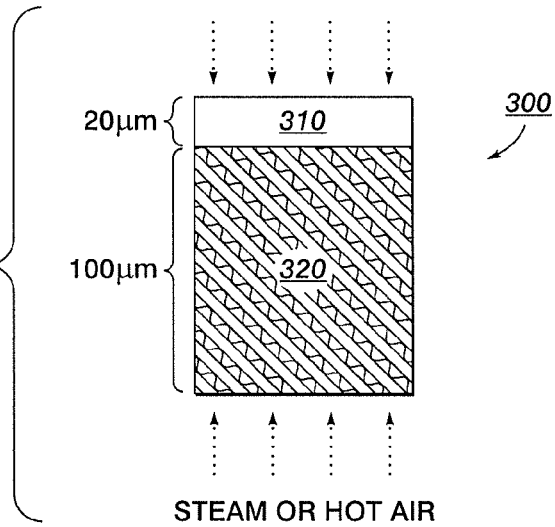
FIG. 3 is a schematic diagram illustrating a model paper and ink stack that is heated symmetrically, from both sides of the paper, using hot air or alternatively, steam.

FIG. 3 is a schematic diagram illustrating a model paper and ink stack 300 that can be heated symmetrically, from both sides of the paper, using hot air or alternatively, steam. Referring to FIG. 3, an ink layer 310 is disposed on a paper layer 320. In this model, the ink layer 310 is 20 μm thick and the paper layer is 100 μm thick. Table 1, which appears below, summarizes relevant physical properties for the paper and ink. The specific values shown in Table 1 are merely examples and other inks and substrates suitable for use with the described embodiments may have different values.

TABLE 1

| | Ink layer 310 | Paper layer 320 |
|---|---|---|
| threshold temperature ($T_0$), in degrees C. | 70 | — |
| specific heat capacity ($C_p$), in kJ/kg · K | 1005 | 1700 |
| thermal conductivity (k), in W/m · K | 0.25 | 0.12 |
| density (ρ), in kg/m$^3$ | 2500 | 800 |

Using the model illustrated in FIG. 3 and the example physical properties of Table 1, the time it takes for different positions of the paper and ink stack 300 to be heated from 30° to 70° C. using hot air or alternatively, steam, may be calculated. These calculations assume that the temperature of steam is 200° C., that the heat transfer coefficient for condensation heat transfer ($h_{cond}$) is 3000 W/m$^2$·K, and that the heat transfer coefficient for convection heat transfer ($h_{conv}$) is 50 W/m$^2$·K. The details of these calculations may be found elsewhere in the art and for convenience are not repeated here, but the results of the calculations are presented below in Table 2.

Table 2 illustrates that the amount of time it takes a position in the paper/ink stack 300 to reach the threshold temperature of the ink (70° C.) using convection heat transfer is over an order of magnitude greater compared to condensation heat transfer. In either case, however, because of the good heat conduction within the ink and paper layers 310, 320, the temperature equalizes across both layers within 10 to 20 ms.

TABLE 2

| position in ink/paper stack | condensation heat transfer (steam) | convection heat transfer (hot air) |
|---|---|---|
| Top of ink layer 310 | 21.4 ms | 615 ms |
| Bottom of ink layer 310 | 30.2 ms | 622 ms |
| Center of paper layer 320 | 45.8 ms | 635 ms |

Figure 4:
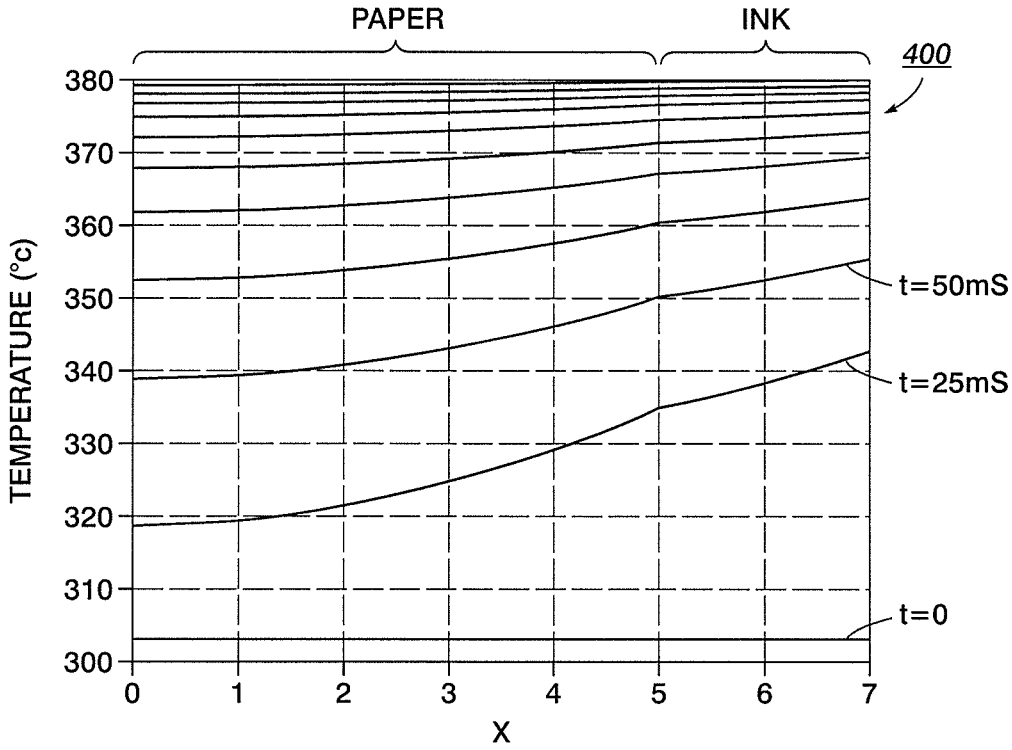
FIG. 4 is a graph that illustrates temperature profiles in the model ink and paper stack of FIG. 3 at different times.

FIG. 4 is a graph 400 that illustrates temperature profiles in the model ink and paper stack 300 of FIG. 3 at different times. On the x-axis, the zero point corresponds to the bottom of the paper layer 320, and every division thereafter is equivalent to 20 μm. The interface between the ink layer 310 and the paper layer 320 corresponds to the numeral five (5). The temperature profiles in graph 400 were calculated at 25 ms intervals. The trace corresponding to t=0 shows that the entire stack 300 initially has a uniform temperature of 30° C. (303° K). Every 25 ms (e.g., at 25 ms, 50 ms, etc.), another temperature profile for the stack 300 is illustrated.

As can be appreciated, when a porous substrate that is to be printed upon is travelling through an ink-leveling system or device in accordance with the described embodiments, synchronization and coordination of the various events that occur will be an important consideration. For example, the time required to heat a substrate layer or ink layer to reach a desired temperature, the velocity at which the substrate is transported through the ink-leveling system or device, the rate at which the substrate layer or ink layer cools, etc., may all be important quantities to know for the system designer.

Given these timing concerns, it is helpful to estimate how quickly ink is drawn into a porous substrate. This process is known as wicking. It is also useful to estimate how quickly an ink layer that exhibits surface roughness will reflow to a desired level of flatness once it reaches a temperature above a threshold temperature $T_0$.

Figure 5:
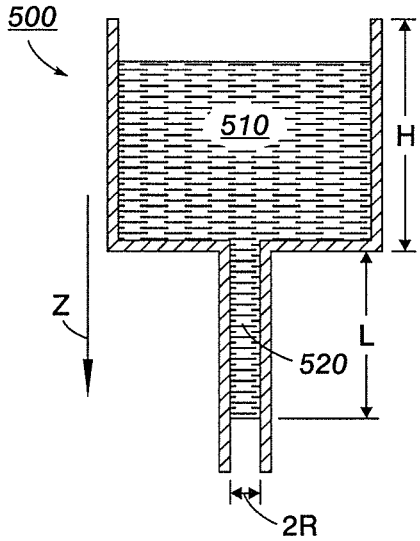
FIG. 5 is a schematic diagram that illustrates a model for estimating how quickly an ink layer will wick into a capillary of a porous substrate.

FIG. 5 is a schematic diagram that illustrates a model 500 for estimating how quickly an ink layer will wick into a capillary of a porous substrate. An ink layer 510 of height H is disposed above a straight capillary 520 of radius R that exists in a substrate. The time it takes for the ink from the ink layer 510 to be drawn down into the capillary 520 by a length L is given by equation 1 below, where η is the viscosity of the ink ($10^{-2}$ Pa·s), σ is the surface tension of the ink ($10^{-3}$ N·m), and θ is the wetting angle (30 degrees). Again, the specific values for η, σ, and θ are just examples.

$$t = \frac{3\eta}{2R\sigma\cos\theta}L^2 \tag{1}$$

Table 3, which appears below this paragraph, presents the results of using equation (1) to estimate how long it takes for ink to be wicked into two differently sized capillaries for selected values of L. As shown in Table 3, a thin ink layer (10-20 μm) will be pulled into the substrate within 10-100 milliseconds. It should be remembered that equation (1) provides only an estimate. In reality, as the ink moves into the porous substrate it does not always encounter a straight capillary, but rather a network of pores of different diameters. The actual wicking dynamics, therefore, may be slower than the estimates shown in Table 3.

TABLE 3

| L (μm) | R = 0.5 μm t (ms) | R = 0.05 μm t (ms) |
|---|---|---|
| 1 | 0.06 | 0.6 |
| 5 | 1.5 | 15 |
| 10 | 6 | 60 |
| 20 | 24 | 240 |
| 50 | 150 | 1500 |

Figure 6:
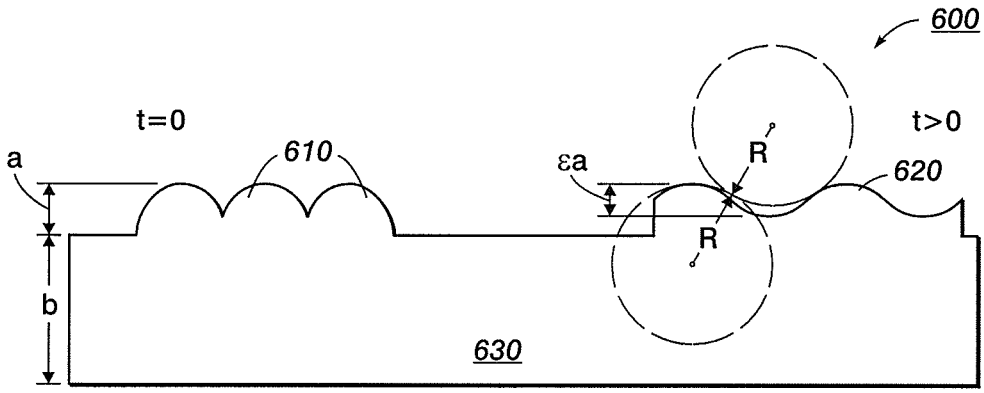
FIG. 6 is a schematic diagram that illustrates a model for estimating a time scale for the reflow characteristics of an ink layer that exhibits an initial surface roughness.

FIG. 6 is a schematic diagram that illustrates a model 600 for estimating a time scale for the reflow characteristics of an ink layer that exhibits an initial surface roughness. On the left side of the model 600, an ink layer 610 is disposed on the substrate 630. Initially, at time t=0, the ink layer 610 exhibits a surface roughness that is characterized as having an initial radius (a). Once the ink layer 610 is above a threshold temperature $T_0$, the connected portions of the ink layer 610 will reflow due to surface tension forces, and look like the ink layer 620 at time t>0. In ink layer 620, the surface flatness is given by (εa), where ε is a measure of the surface flatness compared to the initial state. The radius R for the surface structure of the ink layer 620 can be defined based upon the measure of surface flatness E and the initial radius a of ink layer 610, as given by equation (2) below.

$$R = \frac{1+\varepsilon^2}{4\varepsilon}a \tag{2}$$

The time required for the ink layer 610 to reflow to achieve the surface characteristics of ink layer 620 is given by equation (3) below, where η is the viscosity of the ink and σ is the surface tension of the ink. As can be seen from equation (3), the time required is directly proportional to the viscosity 11 of the ink and the radius R of the surface $$\tau = \frac{\eta R}{\sigma} \tag{3}$$

Equation (4), which appears below, is obtained by substituting equation (2) into equation (3). Equation (4) expresses the reflow time required as a function of the initial surface structure a and the desired measure of surface flatness E.

$$\tau = \frac{1+\varepsilon^2}{4\varepsilon}\frac{\eta a}{\sigma} \tag{4}$$

Table 4, which appears below this paragraph, presents the results of calculating, using equations 2 and 4, the radius R of the surface structure and the required time to achieve the radius R for different values of the desired surface flatness ε. For these calculations, it was assumed that the initial radius a was 21 μm, that the viscosity η of the ink was $10^{-2}$ Pa·s, and that the surface tension σ of the ink was $10^{-3}$ Nm. Of course, the values for a, η, and σ are merely examples that are chosen for illustrative purposes.

TABLE 4

| ϵ | R (m) | τ |
|---|---|---|
| 0.5 (50% leveling) | 1.31E−05 | 1.31E−04 |
| 0.1 (90% leveling) | 5.30E−05 | 5.30E−04 |
| 0.05 (95% leveling) | 1.05E−04 | 1.05E−03 |
| 0.01 (99% leveling) | 5.25E−04 | 5.25E−03 |

From equation (3), the time scale increases with the radius R of the surface structure. This means that it will take an infinite time to achieve a perfectly smooth surface. However, Table 4 illustrates that initial reflow happens on the sub-millisecond time scale. Once the surface roughness is less than a few micrometers, further improvements will take milliseconds and longer to occur. Thus, one can quickly achieve acceptable levels of leveling.

In some embodiments, leveling of the ink layer may also be accomplished by using an external shear force. For example, the external shear force may be applied using an air knife, which directs a jet of air across the ink layer. The temperature of the air may be set at a desired temperature. Applying a shear force may be important in situations where the ink layer is discontinuous, and needs to be pushed onto blank substrate areas.

Figure 7:
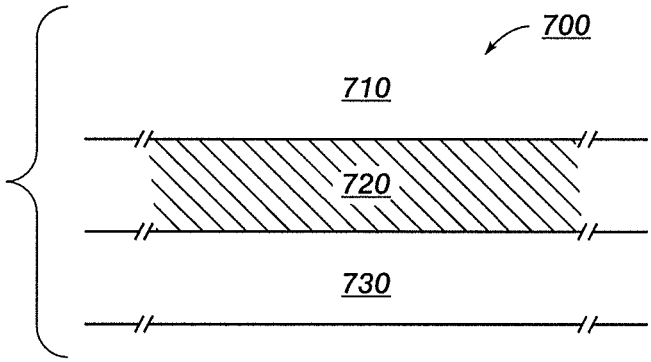
FIG. 7 is a schematic diagram that illustrates a model for estimating the velocity of a top layer of ink due to an applied shear force.

FIG. 7 is a schematic diagram illustrating a model 700 for estimating the velocity of a top layer of ink due to an applied shear force. In the model 700, an ink layer 720 is disposed on a substrate 730, such as paper. An air layer 710 is disposed above the ink layer 720. It is assumed that no slippage occurs between the layers 710, 720, and 730, that the velocity gradient in the air layer 710 is 10 m/s over 1 mm, that the thickness of the ink layer 720 is 10 μm, and that the substrate 730 moves in the horizontal direction (x-direction) at a velocity of 1 m/s. It is further assumed that the viscosity of air ($\eta_{air}$) is $10^{-5}$ Pa·s and the viscosity of ink ($\eta_{ink}$) is $10^{-2}$ Pa·s. Again, the values chosen are typical values selected for illustrative purposes, the actual values may change depending on the particular ink, substrate, velocity of the air, etc.

The shear forces in the air layer 710 and the ink layer 720 are given by equations (5) and (6), respectively, where u is the velocity of the air or ink, respectively.

$$F = \eta_{air} \frac{\partial u}{\partial y}\bigg|_{air} \tag{5}$$

$$F = \eta_{ink} \frac{\partial u}{\partial y}\bigg|_{ink} \tag{6}$$

Because there is no slipping between the air layer 710 and the ink layer 720, it can be safely assumed that at the interface between the air layer and ink layer, equation (5) is equivalent to equation (6). Additionally, it can be assumed that the rate of change of velocity in the ink layer 720 is linear. Equation (7), which is an expression for the velocity of the top layer of ink, results from these assumptions. In equation (7), $H_{ink}$ is a constant resulting from the derivation of equation (7) from equations (5) and (6).

$$u = H_{ink} \frac{\eta_{air}}{\eta_{ink}} \frac{\partial u}{\partial y}\bigg|_{air} = 10^{-3} \frac{m}{s} \tag{7}$$

Using equation (7), the time required to move the surface element of ink, for example, by 10 μm and 100 μm, is 10 ms and 100 ms, respectively. Multiplying 10 ms and 100 ms by the velocity of the paper (1 m/s) results in the length L of the shear zone required to achieve this surface movement. Thus, in order to move the surface element of ink by 10 μm, a shear zone of 10 mm is required. In order to move the surface element of ink by 100 μm, a shear zone of 100 mm is required. These lengths most likely would require the use of more than one air knife.

Figure 8:
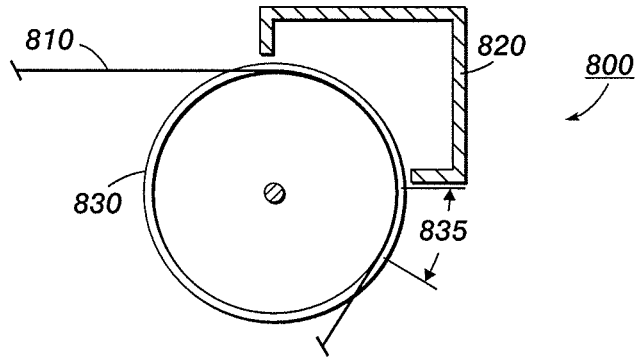
FIG. 8 is a schematic profile view diagram illustrating some components included in an ink leveling device in accordance with example embodiments.
Figure 9:
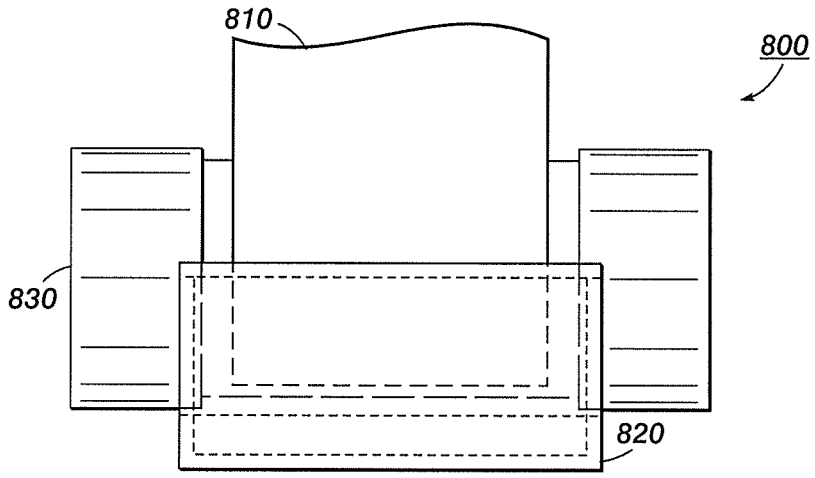
FIG. 9 is a schematic top view diagram of the device of FIG. 8.

FIG. 8 is a schematic profile view diagram illustrating some components included in an ink leveling device 800 in accordance with example embodiments. FIG. 9 is a schematic top view diagram of the ink leveling device 800. Referring to FIGS. 8 and 9, the device 800 includes a cylinder 830 and a steam chamber 820 in proximity to the cylinder. A substrate 810, such as porous paper 810, is transported through the steam chamber 820 using the cylinder 830. An unleveled ink layer (not shown) is disposed on the upper side of the substrate 810. As the substrate 810 passes through the steam chamber 820, the unleveled ink is heated above a threshold temperature $T_0$ of the ink.

Note that in FIG. 8, the porous paper 810 is in the form of a web, which is known in the art as a long, continuous length of paper that is stored in a roll. After printing, the web is cut into sheets. This is sometimes referred to as a web-fed system. The invention is not limited to web-fed systems however, as alternative embodiments of the invention may be sheet-fed systems, or a system in which the paper is cut to a desired size before the ink is applied.

In some embodiments, the cylinder 830 is cooled and rotates about an axis of rotation of the cylinder, and the bottom of the substrate 810 is in contact with the cooled cylinder as is passes through the steam chamber 820. In other embodiments, the cylinder 830 may be stationary and use a cold air bearing (not shown) that uses a cushion of cooled air to maintain the substrate 810 at some distance from the surface of the cylinder. In this case, the substrate 810 would be pulled through the steam chamber 820 by another roller (not shown). The cooled cylinder and cold air bearing are just two possible examples. The term "cooling surface" will be used in this disclosure to refer generally to any surface that can cool the substrate, either by contact with the substrate or by some other means. Thus, the cooled cylinder and cold air bearing are two examples of a device that includes a cooling surface. It will be apparent to those of skill in the art that other known substrate transport mechanisms are suitable for use with example embodiments.

In the manner described above, the unleveled ink layer on the top side of the substrate is heated above a threshold temperature $T_0$ of the ink, while the bottom side is held at a low temperature by the cylinder 830. This creates a thermal gradient through the substrate 810, such as the thermal gradient 205 shown in FIG. 2. As was described above, heating the unleveled ink layer allows the ink layer to reflow, thereby leveling the ink. As the substrate 810 leaves the steam chamber 820, it is actively cooled in a quench zone 835 of the cylinder 830, although the quench zone 835 is optional.

In FIG. 8, the substrate 810 is shown as coming into contact with the cylinder 830 at approximately the same time it enters the steam chamber 820. Optionally, according to other embodiments, the relative position at which the substrate 810 contacts the cylinder 830 may be altered so that the substrate 810 is actively chilled by the cylinder (through contact with the cylinder or by chilled air bearings on the cylinder) before the substrate enters the steam chamber 820. This is done to ensure that the substrate 810 and ink layer are cooled to well below the threshold temperature $T_0$ of the ink across its entire thickness to better maintain the desired steep thermal gradient as the substrate passes through the steam chamber 820.

Figure 10:
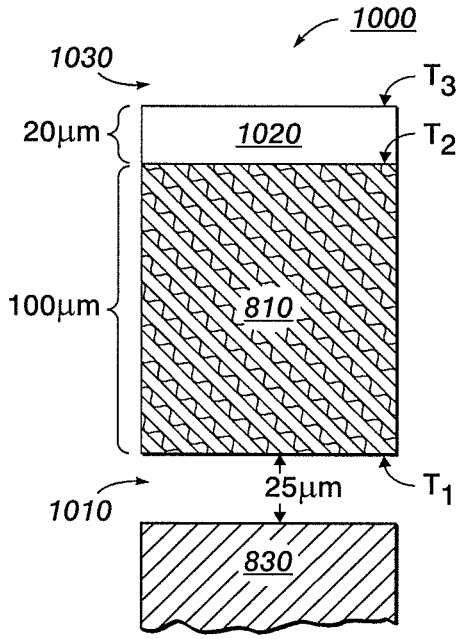
FIG. 10 is a schematic diagram that illustrates a thermal model for the ink leveling device of FIG. 8.

FIG. 10 is a schematic diagram that illustrates a thermal model 1000 for the ink leveling device 800 of FIG. 8. The model 1000 shows the ink layer 1020 disposed on the substrate 810, while the cylinder 830 is separated from the bottom of the substrate by an air gap 1010. The air gap 1010 models the heat resistance between the substrate 810 and the cylinder 830. For purposes of this illustration, the thicknesses of the ink layer 1020, the substrate 810, and the air gap 1010 are chosen as 20, 100, and 25 μm, respectively. Above the ink layer 1020, there is a region 1030 where the steam is applied. The physical properties of the ink layer 1020 and the substrate 810 are assumed to be the same as those for the ink layer 310 and the paper layer 320, respectively, as summarized in Table 1 above.

Figure 11:
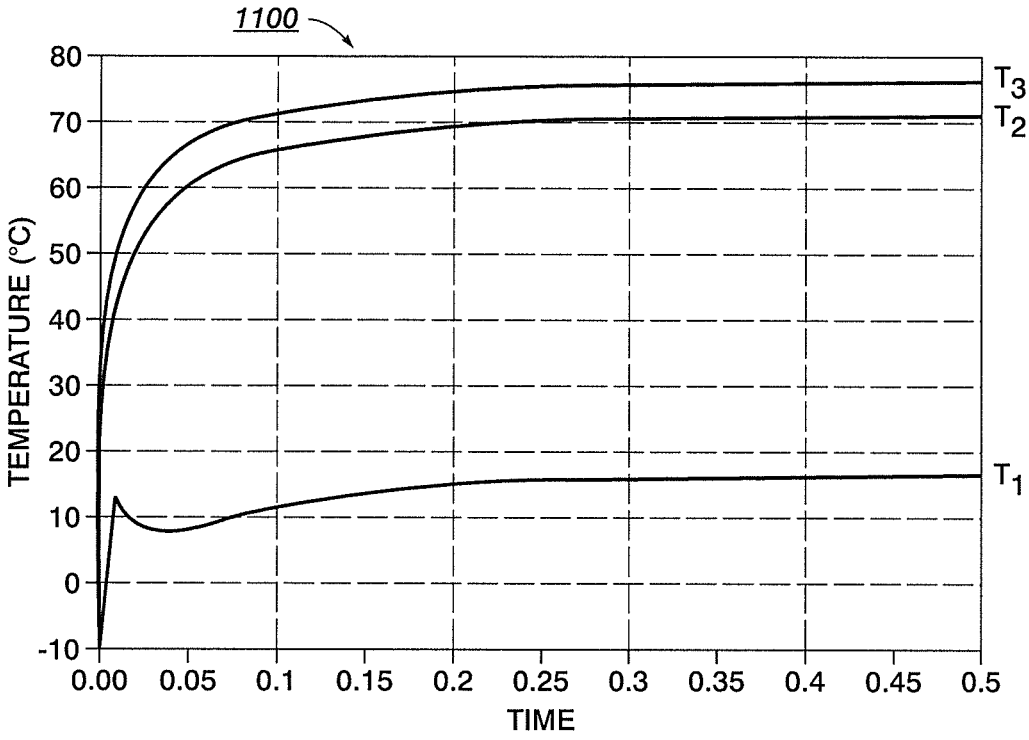
FIG. 11 is a graph illustrating the temperature as a function of time at selected positions across the thermal model of FIG. 10 after steam is applied.
Figure 12:
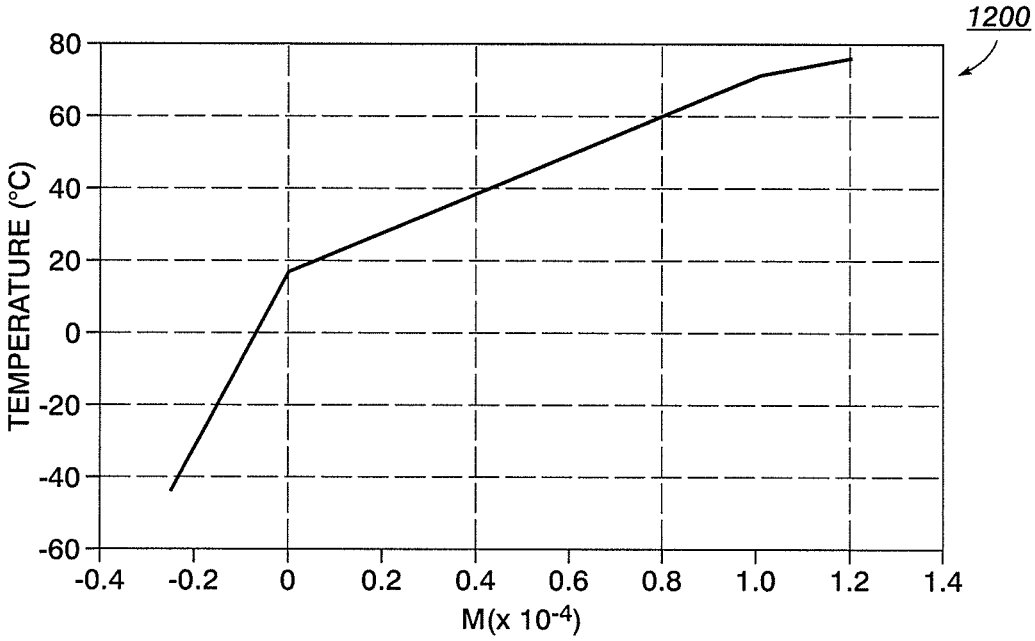
FIG. 12 is a graph illustrating the steady-state temperature profile of the thermal model of FIG. 10 after steam is applied.

FIG. 11 is a graph 1100 illustrating the temperature as a function of time at selected positions across the model 1000 of FIG. 10 after steam is applied. FIG. 12 is a graph 1200 illustrating the steady-state temperature profile of the model 1000 of FIG. 10 after steam is applied. In FIG. 12, zero (0) on the x-axis corresponds to the interface between the air gap 1010 and the substrate 810. For the calculations used to obtain FIGS. 11 and 12, it was assumed that the temperature of the steam applied in region 1030 was at 107° C. The associated heat transfer coefficients ($h_{CV}$, $h_{CD}$)) for convective heat transfer and condensation heat transfer for steam at this temperature is 100 $W/m^2 \cdot k$, and 2000 $W/m^2 \cdot k$, respectively.

FIGS. 11 and 12 illustrate that while steam is very efficient for quickly heating the ink layer 1020 to a desired temperature, in order to maintain a threshold temperature $T_0$ just under the ink layer 1020, the cylinder 830 must be kept at about −43° C. This causes a relatively high heat flux even under steady-state conditions (about $6.5 \times 10^4$ $W/m^2$), and it also results in a relatively high condensation rate (about 27 $g/cm^2$), which may not be desirable.

Figure 13:
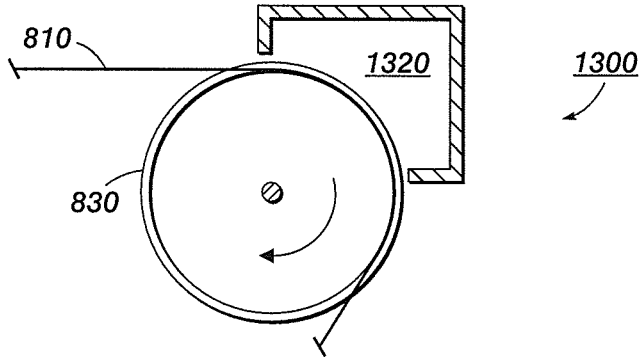
FIG. 13 is a schematic profile view diagram illustrating some components of an ink leveling device in accordance with other example embodiments.

FIG. 13 is a schematic profile view diagram illustrating some components of an ink leveling device 1300 in accordance with other example embodiments. Device 1300 is similar to device 800 of FIG. 8, but in device 1300 there is a hot air chamber 1320 in proximity to the cylinder 830 rather than the steam chamber 820. Because the devices are so similar, the thermal model 1000 of FIG. 10 that was used for simulating device 800 may also be used to simulate device 1300, where the only adjustment needed is the introduction of hot air into region 1030 rather than steam.

Figure 14:
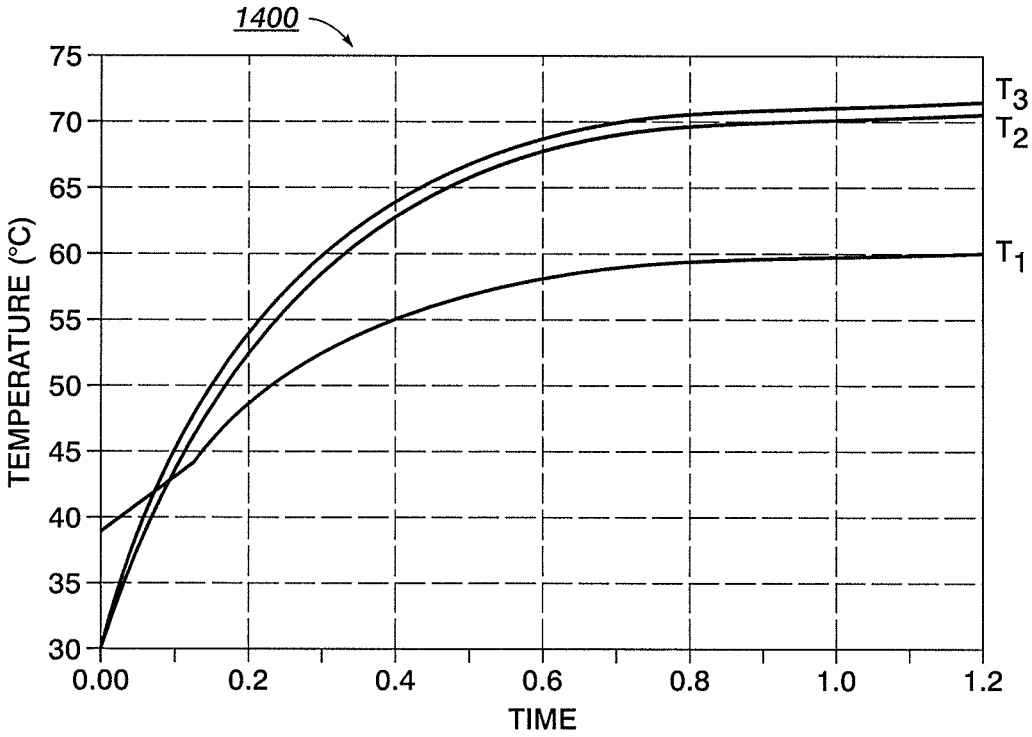
FIG. 14 is a graph illustrating the temperature as a function of time at selected positions across the thermal model of FIG. 10 after hot air is applied.
Figure 15:
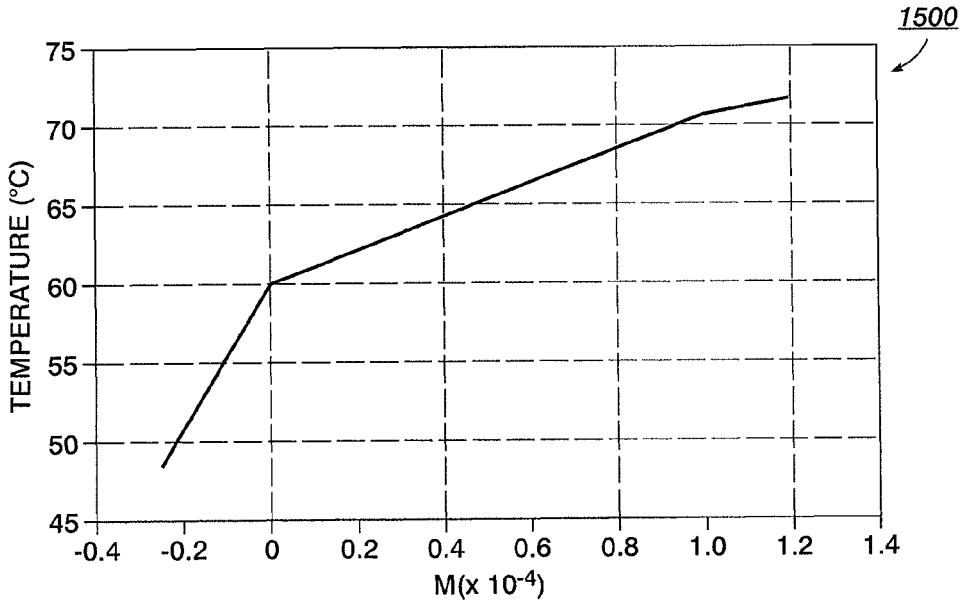
FIG. 15 is a graph illustrating the steady-state temperature profile of the thermal model of FIG. 10 after hot air is applied.

FIG. 14 is a graph 1400 illustrating the temperature as a function of time at selected positions across the model 1000 of FIG. 10 after hot air is applied. FIG. 15 is a graph 1500 illustrating the steady-state temperature profile of the model 1000 of FIG. 10 after hot air is applied. In FIG. 15, zero (0) on the x-axis corresponds to the interface between the air gap 1010 and the substrate 810. For the calculations used to obtain FIGS. 14 and 15, it was assumed that the temperature of the hot air applied in region 1030 was at 200° C. The associated heat transfer coefficient ($h_{CV}$) for convective heat transfer for hot air at this temperature is 100 $W/m^2 \cdot k$.

FIGS. 14 and 15 illustrate that hot air is significantly less efficient than steam for heating the ink layer 1020 to a desired temperature. On the other hand, the temperature across the entire substrate 810 may be kept below the threshold temperature $T_0$ by maintaining the temperature of the cylinder at only 48° C. The steady-state heat flux in this case is about $1.28 \times 10^4$ $W/m^2$, about 80% less than the case where steam was used, with no associated condensation.

It should be apparent that while the ink-leveling devices according to FIG. 8 and FIG. 13 can both establish a desired thermal gradient within the substrate 810, the performance of the steam-only option and the hot air only option for heating the ink layer 1020 is not ideal. The steam-only option has a high associated steady-state heat flux, while the hot air only option takes a relatively long time to raise the ink layer to the desired temperature.

The inventors have found that one can advantageously obtain the advantages of both methods by quickly heating the ink layer 1020 to above the threshold temperature $T_0$ using steam, then switching to hot air to slow down the heating rate. This avoids raising the temperature of the substrate 810 above $T_0$.

Figure 16:
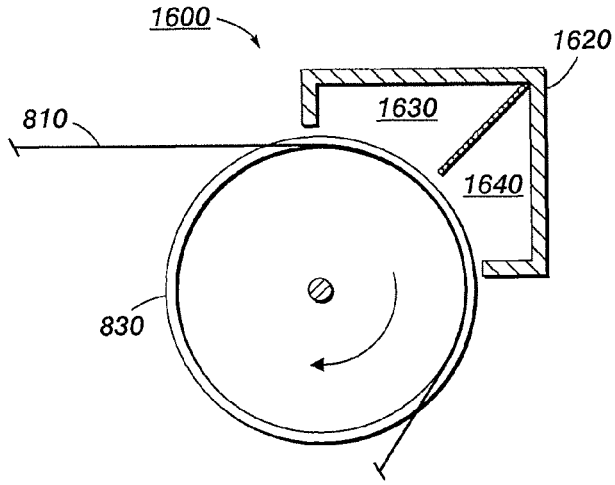
FIG. 16 is a schematic profile view diagram illustrating some components of an ink leveling device in accordance with other example embodiments.

FIG. 16 is a schematic profile view diagram illustrating some components of an ink leveling device 1600 in accordance with other example embodiments. Device 1600 is similar to device 800 of FIG. 8 and device 1300 of FIG. 13, but in device 1600 there is a dual-chamber chamber 1620. The dual-chamber chamber 1620 includes a steam chamber 1630 and a hot air chamber 1640. It should be apparent that in alternative embodiments, two separate chambers, one using steam and one using hot air, may be used in a sequential manner.

Because the devices are similar, the thermal model 1000 of FIG. 10 that was used for simulating device 800 and 1300 may also be used to simulate device 1600, where the only modification needed is that steam is first introduced into region 1030 for a first period of time, then hot air is introduced into region 1030 for a second period of time. Of course, in the device 1600 steam and hot air are actually introduced into two physically different regions, but for purposes of the simulation this simplification is acceptable because the steam and hot air are not being applied to the substrate 810 simultaneously.

Figure 17:
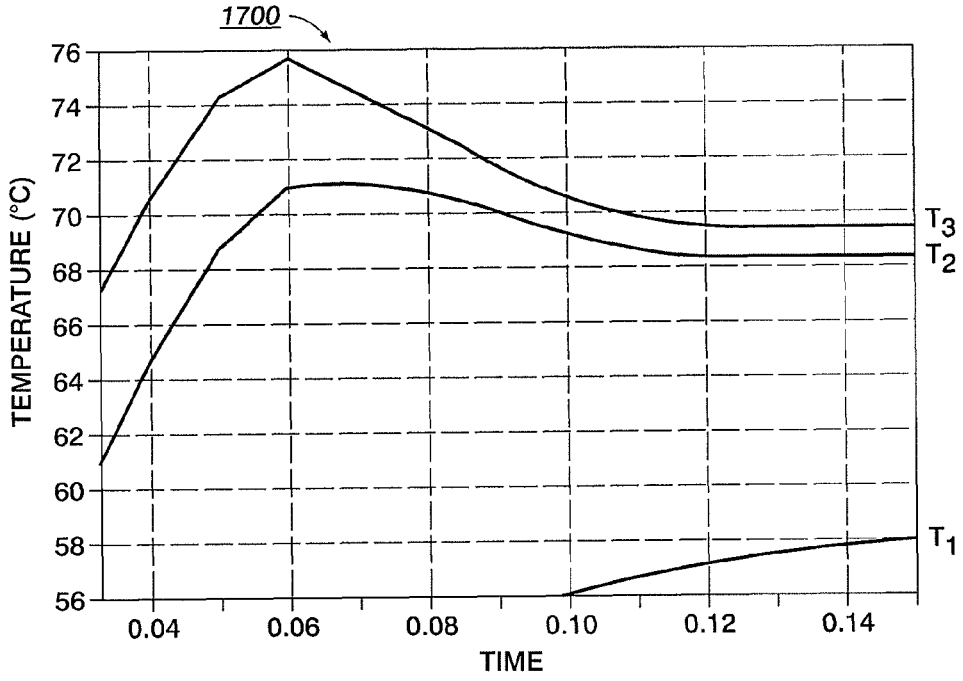
FIG. 17 is a graph illustrating the temperature as a function of time at selected positions across the thermal model of FIG. 10 after steam, then hot air, are sequentially applied.
Figure 18:
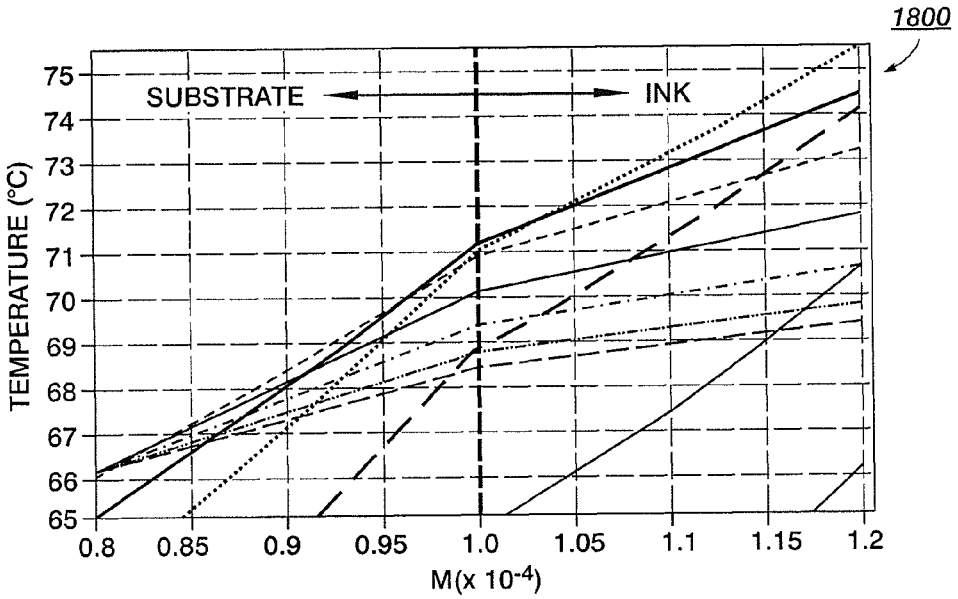
FIG. 18 is a graph illustrating temperature profiles of the thermal model of FIG. 10 at different times after steam, then hot air, are sequentially applied.

FIG. 17 is a graph 1700 illustrating the temperature as a function of time at selected positions across the model 1000 of FIG. 10 after steam, then hot air, are sequentially applied. FIG. 18 is a graph 1800 illustrating temperature profiles of the thermal model 1000 of FIG. 10 at different times after steam, then hot air, are sequentially applied. In FIG. 18, one (1) on the x-axis corresponds to the interface between the ink layer 1020 and the substrate 810. For the calculations used to obtain FIGS. 17 and 18, it was assumed that steam at a temperature of 200° C. was first applied for $t<60$ ms, followed by application of hot air at 200° C. for $t>60$ ms. The associated heat transfer coefficient ($h_{CV}$) for convective heat transfer for hot air at this temperature is 100 $W/m^2 \cdot k$, while the associated heat transfer coefficient ($h_{CD}$) for condensation heat transfer during the steam application phase is 2000 $W/m^2 \cdot k$.

FIGS. 17 and 18 illustrate that, by choosing the correct geometries and temperatures for both the steam chamber 1630 and hot air chamber 1640, a well-defined time window can be created in which the ink temperature is above the threshold temperature $T_0$, while substantially all of the substrate temperature stays below the threshold temperature $T_0$. For example, the T3 trace of FIG. 17 shows that the top of the ink layer 1020 is above the threshold temperature $T_0$ for about 70 ms, while the T2 trace shows that the bottom of the ink layer is above the threshold temperature $T_0$ for about 40 ms. FIG. 18 illustrates that only about 3-4 μm of the substrate is raised above the threshold temperature $T_0$.

Figure 19:
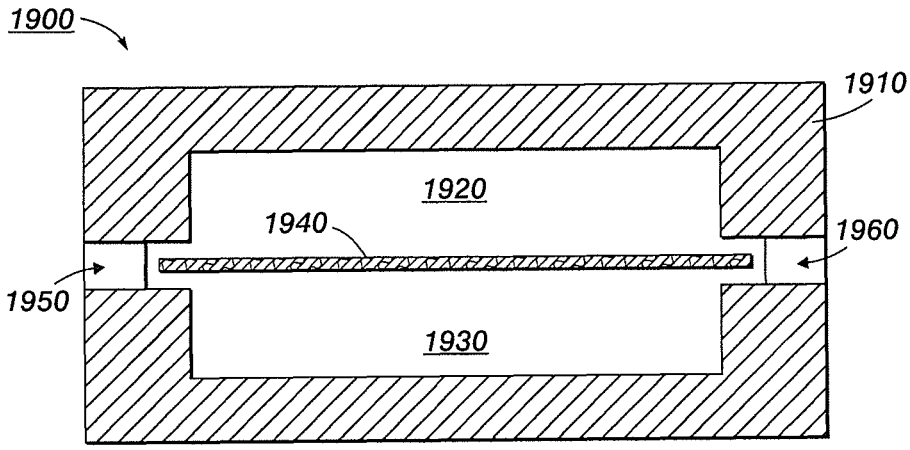
FIG. 19 is a schematic profile view diagram illustrating some components of an ink leveling device in accordance with other example embodiments.

FIG. 19 is a schematic profile view diagram illustrating some components of an ink leveling device 1900 in accordance with other example embodiments. The ink leveling device 1900 includes a heating/cooling chamber 1910 that is operable to establish the desired thermal gradient across the substrate 1940. The substrate 1940, with an ink layer (not shown) disposed thereon, enters the heating/cooling chamber 1910 at entry 1950 and leaves the heating/cooling chamber 1910 at exit 1960. A variety of mechanisms may be used to draw the substrate 1940 through the heating/cooling chamber 1910. These mechanisms are well understood and are not critical for an understanding of the described embodiment.

The heating/cooling chamber 1910 is divided into a heating chamber 1920 and a cooling chamber 1930. The substrate 1940 separates the heating chamber 1920 from the cooling chamber 1930. The impedance of the gap between the heating chamber 1920 and the cooling chamber 1930 is high enough so that minimal thermal exchange occurs between the heating chamber and the cooling chamber. As the substrate 1940 travels across the heating/cooling chamber 1910, the ink layer on the top side of the substrate 1940 is heated by the heating chamber 1920 while the bottom surface of the substrate is cooled by the cooling chamber 1930. As was the case with the embodiments that were described above, the heating chamber 1920 of the heating/cooling chamber 1910 may heat the substrate 1940 using steam or hot air, but the best performance is achieved by sequentially heating the substrate using first steam, followed by an application of hot air. The cooling chamber 1930 is preferably used to introduce cool air on the underside of the substrate 1940, but any suitable cool fluid may be used. The heating chamber 1920 and the cooling chamber 1930 establish the desired thermal gradient across the substrate 1940.

Figure 20:
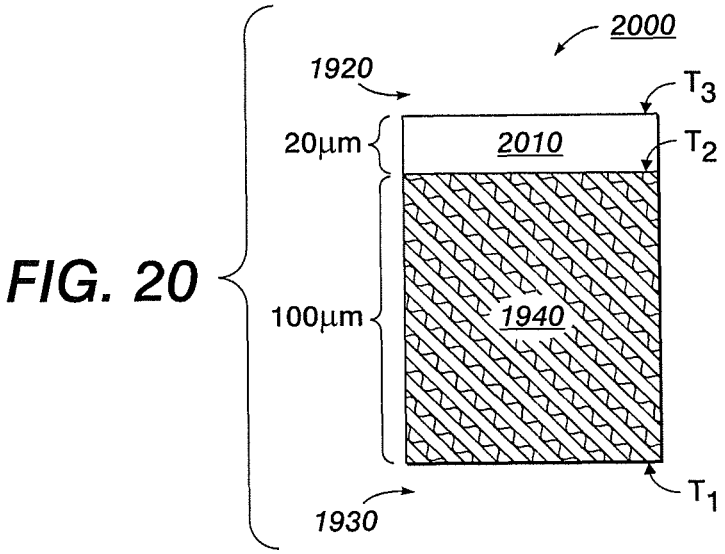
FIG. 20 is a schematic diagram that illustrates a thermal model for the ink leveling device of FIG. 19.

FIG. 20 is a schematic diagram that illustrates a thermal model 2000 for the ink leveling device 1900 of FIG. 19. The thermal model 2000 shows an ink layer 2010 disposed on the substrate 1940. For purposes of this illustration, the thicknesses of the ink layer 2010 and the substrate 1940 are chosen as 20 and 100 μm, respectively. The physical properties of the ink layer 2010 and the substrate 1940 are assumed to be the same as those for the ink layer 310 and the paper layer 320, respectively, as summarized in Table 1 above.

Figure 21:
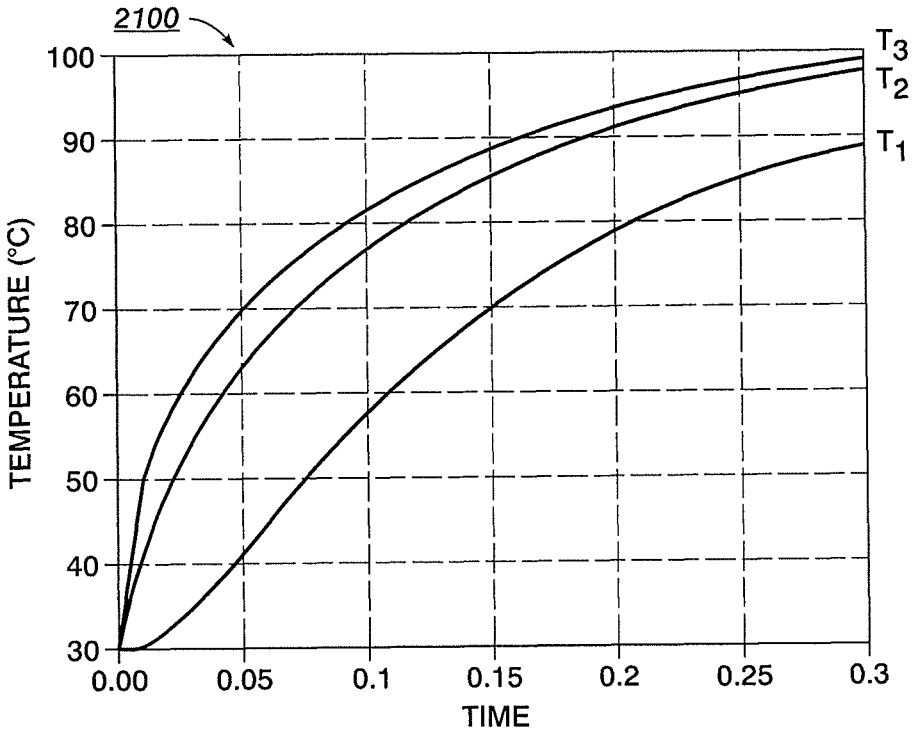
FIG. 21 is a graph illustrating the temperature as a function of time at selected positions across the thermal model of FIG. 20 when steam is introduced into the heating chamber and cool air is introduced into the cooling chamber.

FIG. 21 is a graph 2100 illustrating the temperature as a function of time at selected positions across the thermal model 2000 of FIG. 20 when steam is introduced into the heating chamber 1920 and cool air is introduced into the cooling chamber 1930. It was assumed that the temperature of the steam applied in the heating chamber 1920 was at 107° C. The associated heat transfer coefficients ($h_{CV}$, $h_{CD}$) for convective heat transfer and condensation heat transfer for steam at this temperature is 100 W/m$^2$·k, and 2000 W/m$^2$·k, respectively. It was further assumed that the temperature of the cool air applied in the cooling chamber 1930 was at 23° C. The associated heat transfer coefficient ($h_{CV}$) for convective heat transfer for cool air at this temperature is 100 W/m$^2$·k. For these chosen boundary conditions, graph 2100 illustrates that there is about a 20 ms window over which the top of the ink layer 2010 (trace T3) is above the threshold temperature $T_0$ (70° C.), while the top of the substrate 1940 (trace T2) is below the threshold temperature $T_0$.

Figure 22:
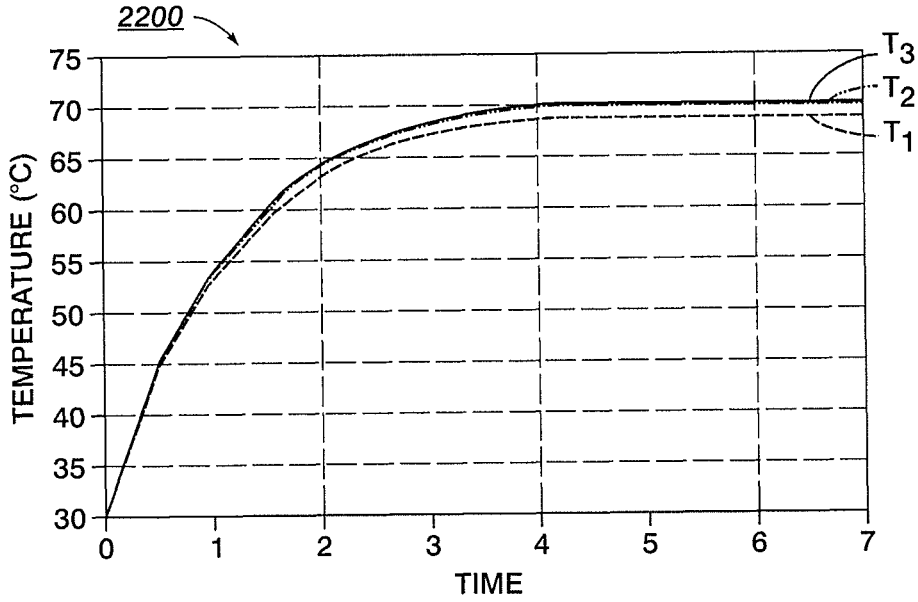
FIG. 22 is a graph illustrating the temperature as a function of time at selected positions across the thermal model of FIG. 20 when hot air is introduced into the heating chamber and cool air is introduced into the cooling chamber.
Figure 23:
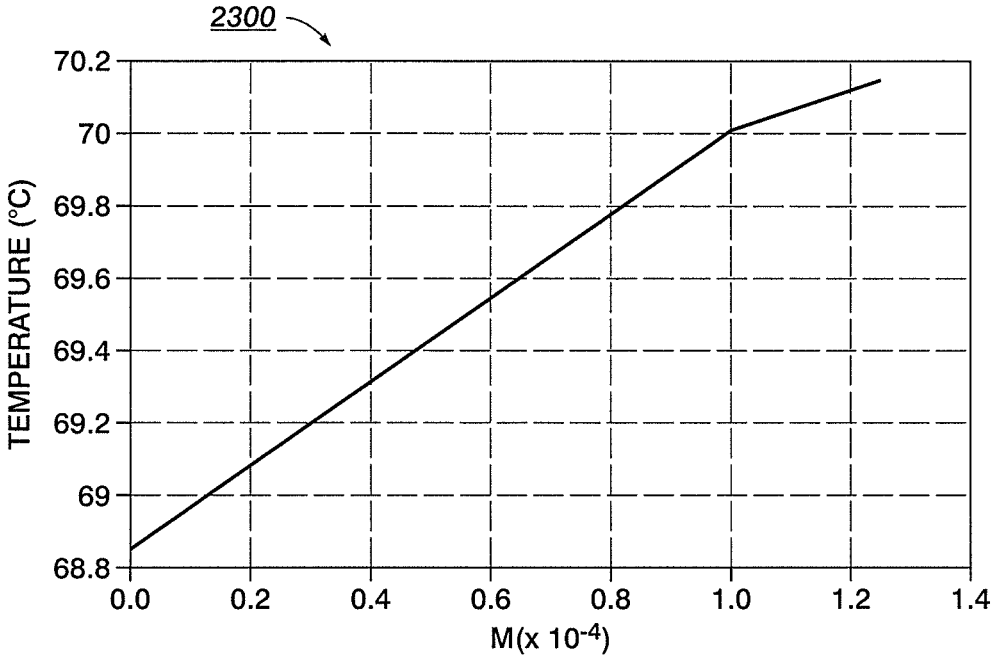
FIG. 23 is a graph illustrating the steady-state temperature profile of the thermal model of FIG. 20 when hot air is introduced into the heating chamber and cool air is introduced into the cooling chamber.

FIG. 22 is a graph 2200 illustrating the temperature as a function of time at selected positions across the thermal model 2000 of FIG. 20 when hot air is introduced into the heating chamber 1920 and cool air is introduced into the cooling chamber 1930. FIG. 23 is a graph 2300 illustrating the steady-state temperature profile of the thermal model 2000 of FIG. 20 when hot air is introduced into the heating chamber 1920 and cool air is introduced into the cooling chamber 1930. It was assumed that the temperature of the hot air applied in the heating chamber 1920 was at 84° C. It was further assumed that the temperature of the cool air applied in the cooling chamber 1930 was at 55° C. The associated heat transfer coefficient ($h_{CV}$) for convective heat transfer of the air was assumed to be 100 W/m$^2$·k.

Like FIGS. 14 and 15, FIGS. 22 and 23 illustrate that hot air is significantly less efficient than steam for heating the ink layer 2010 to a desired temperature. On the other hand, the temperature across the entire substrate 1940 may be kept below the threshold temperature $T_0$ by supplying cooling air at 55° C. The steady-state heat flux in this case is about $1.4\times10^3$ W/m$^2$.

Figure 24:
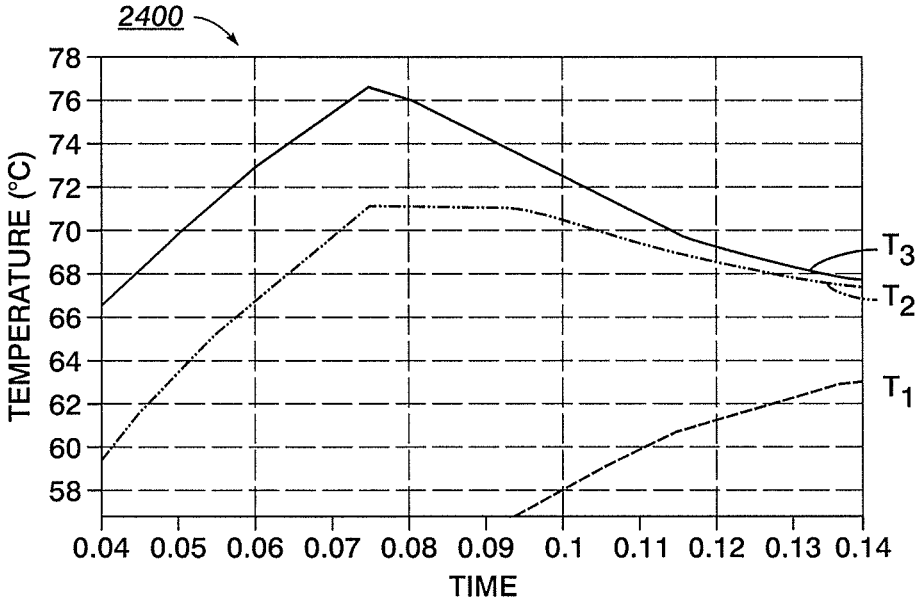
FIG. 24 is a graph illustrating the temperature as a function of time at selected positions across the thermal model of FIG. 20 when steam, then hot air, are introduced into the heating chamber and cool air is introduced into the cooling chamber.
Figure 25:
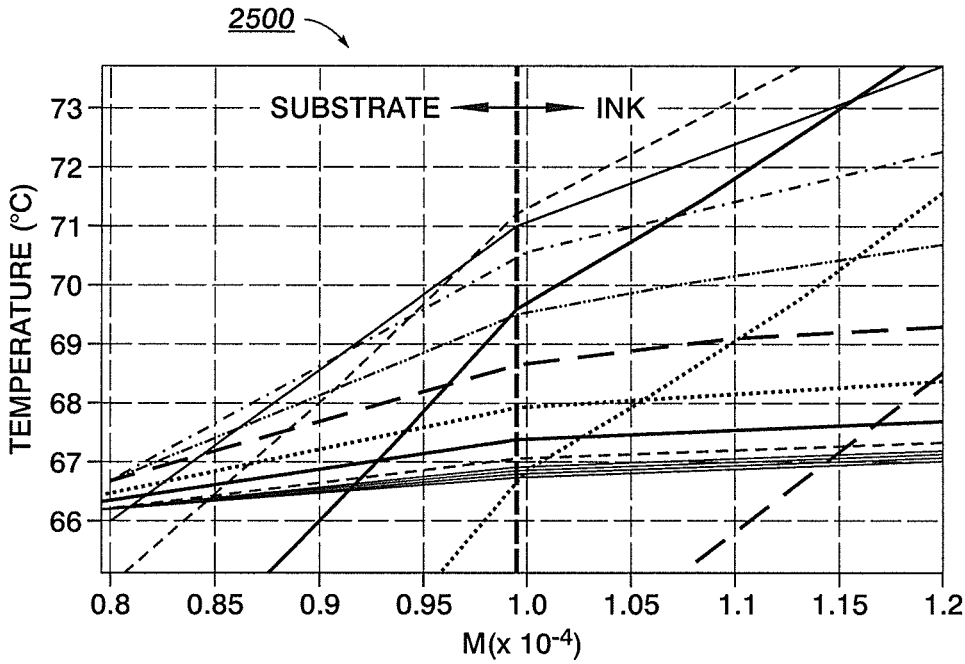
FIG. 25 is a graph illustrating temperature profiles of the thermal model of FIG. 20 at different times when steam and hot air are sequentially introduced into the heating chamber and cool air is introduced into the cooling chamber.

FIG. 24 is a graph 2400 illustrating the temperature as a function of time at selected positions across the thermal model 2000 of FIG. 20 when steam, then air, is introduced into the heating chamber 1920 and cool air is introduced into the cooling chamber 1930. FIG. 25 is a graph 2500 illustrating temperature profiles of the thermal model 2000 of FIG. 20 at different times when steam and hot air are sequentially introduced into the heating chamber 1920 and cool air is introduced into the cooling chamber 1930.

It was assumed that steam at a temperature of 107° C. was applied in the heating chamber 1920 for t<60 ms, and that hot air at a temperature of 107° C. was applied in the heating chamber for t>60 ms. During this time, it was assumed that cooling air at a temperature of 23° C. was applied in the cooling chamber 1930. As before, the associated heat transfer coefficients ($h_{CV}$, $h_{CD}$) for convective heat transfer and condensation heat transfer are 100 W/m$^2$·k and 2000 W/m$^2$·k, respectively.

Similar to FIGS. 17 and 18, FIGS. 24 and 25 illustrate that by choosing the correct geometries and temperatures for both the heating chamber 1920 and cooling chamber 1930, a well-defined time window can be created in which the temperature of the ink layer 2010 is above the threshold temperature $T_0$, while most of the substrate 1940 temperature is below the threshold temperature $T_0$. For example, the T3 trace of FIG. 24 shows that the top of the ink layer 2010 is above the threshold temperature $T_0$ for about 70 ms, while the T2 trace shows that the top of the substrate 1940 is concurrently above the threshold temperature $T_0$ for about 40 ms. FIG. 25 illustrates that only about 3-4 μm of the substrate 1940 is raised above the threshold temperature $T_0$.

It should be apparent from the example embodiments described above that for a given set of substrate and ink parameters and for a given substrate transport speed the length of the heating zone and cooling zone can be set to achieve the desired time for reflow of the ink at low viscosity. Additionally, it may be desirable to provide better control of the ink motion and optionally the subsequent cooling of the substrate and the quenching of the ink.

Figure 26:
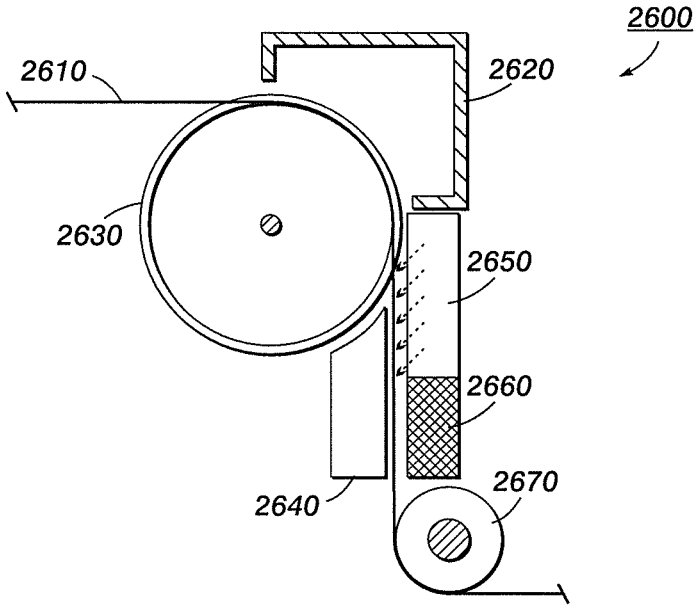
FIG. 26 is a schematic profile view diagram illustrating some components included of an ink leveling device 2600 in accordance with example embodiments.

FIG. 26 is a schematic profile view diagram illustrating some components included of an ink leveling device 2600 in accordance with example embodiments. Like the ink leveling device 800 of FIG. 8, the ink leveling device 2600 includes a cylinder 2630 and an chamber 2620 disposed in proximity to the cylinder 2630. The top of the substrate 2610, with an ink layer (not shown) disposed thereon, is heated as it passes through the chamber. At the same time, as was explained above, the bottom of the substrate 2610 may be cooled by implementing the cylinder 2630 either as a cooled rotating cylinder or as providing a stationary cylinder with a cold air bearing. This establishes the desired thermal gradient through across the substrate 2610 and ink layer.

The ink leveling device 2600 further includes an air knife leveler 2650, which is operable to apply jets of hot air across the top surface of the substrate 2610 and thereby advantageously shearing the surface of the ink layer according to the principles described in FIG. 7 above. After the air knife leveler 2650, the substrate 2610 and ink layer pass under an Ultra-Violet (UV) curing lamp 2660. The UV curing lamp 2660 is operable to bathe the ink layer in UV light, thereby setting the ink layer in its final desired configuration. To minimize out-of-plane motion, the ink leveling device 2600 further includes an air bearing 2640 to support the substrate 2610. The turning cylinder 2670 is one example of the many possible substrate guiding possibilities suitable for use with the described embodiments.

Generally speaking, text or images that were previously printed on the bottom side of the substrate 2610 will have already been cured. Otherwise, if they remain in the gel state, they will readily offset onto any contacting surfaces, which may include, for example, the surface of the cylinder 2630. Another approach to ensure that the images previously printed on the bottom side of the substrate 2610 remain unchanged is to maintain the bottom surface of the substrate below the threshold temperature by actively cooling the transport elements, although the UV curing approach described above would be more reliable.

According to the example embodiments described above, the bottom of the substrate was actively cooled while the ink layer on top of the substrate was actively heated using steam, hot air, or a combination of both to create a temperature gradient across the substrate where a substantially all of the substrate is maintained at a temperature below the threshold temperature of the ink. In other example embodiments, the same desirable temperature gradients could be achieved by pre-heating the ink to a sufficiently high temperature before it was printed on the substrate, pre-cooling the substrate to a sufficiently low temperature before the ink was printed on the substrate, or by a combination of both. It is foreseen that by carefully adjusting the temperature parameters for the desired inks and substrates, the ink could be kept at a viscosity level sufficiently high so that the ink layer would never develop the undesirable corduroy structure that was described in the background section.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of leveling ink on a substrate, the method comprising establishing a thermal gradient across a thickness of the substrate by heating the top surface of the substrate while cooling the lower surface of the substrate, the thermal gradient characterized in that a substrate temperature is less than a viscosity threshold temperature of the ink across most of the substrate; and wherein the ink is a gel ink.

2. The method of claim 1, the thermal gradient characterized in that a substrate temperature is greater than the viscosity threshold temperature of the ink across no more than about a top 25% of the substrate.

3. The method of claim 2, the thermal gradient characterized in that it is less than the viscosity threshold temperature of the ink across substantially all of the substrate.

4. The method of claim 1, further comprising:

heating the ink to a high temperature that is greater than the viscosity threshold temperature of the ink; and applying the ink to the upper surface of the substrate.

5. The method of claim 1, wherein establishing the thermal gradient across the thickness of the substrate comprises:

applying the ink to an upper surface of the substrate;

cooling the lower surface of the substrate to a first temperature that is less than the viscosity threshold temperature of the ink; and heating the ink and the upper surface of the substrate to a second temperature that is greater than the viscosity threshold temperature of the ink.

6. The method of claim 5, wherein cooling the lower surface of the substrate comprises contacting the lower surface to a cooled cylinder.

7. The method of claim 5, wherein cooling the lower surface of the substrate comprises cooling the lower surface of the substrate with chilled air.

8. The method of claim 5, wherein heating the ink and the upper surface of the substrate comprises heating the ink and the upper surface of the substrate with steam.

9. The method of claim 5, wherein heating the ink and the upper surface of the substrate comprises heating the ink and the upper surface of the substrate with hot air.

10. The method of claim 1, wherein the viscosity threshold temperature of the ink is defined as a temperature where a viscosity of the ink is approximately midway between a maximum viscosity of the ink and a minimum viscosity of the ink on a logarithmic scale.

11. The method of claim 5, wherein heating the ink and the upper surface of the substrate comprises heating the ink and the upper surface of the substrate with a combination of steam and hot air.

* * * * *